US011260999B2

(12) United States Patent
Ehrmann

(10) Patent No.: US 11,260,999 B2
(45) Date of Patent: Mar. 1, 2022

(54) THERMOFORMING PACKAGING MACHINE WITH FILM DEFLECTION

(71) Applicant: Multivac Sepp Haggenmüller SE & Co. KG, Wolfertschwenden (DE)

(72) Inventor: Elmar Ehrmann, Bad Grönenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 209 days.

(21) Appl. No.: 16/353,510

(22) Filed: Mar. 14, 2019

(65) Prior Publication Data

US 2019/0283913 A1 Sep. 19, 2019

(30) Foreign Application Priority Data

Mar. 16, 2018 (DE) ..... 102018204044.3

(51) Int. Cl.
*B65B 5/02* (2006.01)
*B65B 47/02* (2006.01)
(Continued)

(52) U.S. Cl.
CPC ..... *B65B 41/12* (2013.01); *B65B 5/02* (2013.01); *B65B 9/045* (2013.01); *B65B 25/06* (2013.01);
(Continued)

(58) Field of Classification Search
CPC ..... B65B 43/08; B65B 47/02; B65B 47/04; B65B 41/16; B65B 9/04; B65B 61/02;
(Continued)

(56) References Cited

U.S. PATENT DOCUMENTS 3,732,789 A * 5/1973 Hartleib ..... B65B 9/067 493/302
3,805,486 A * 4/1974 Mahaffy ..... B65B 31/021 53/559
(Continued)

FOREIGN PATENT DOCUMENTS

DE 2014650 A1 10/1970
DE 4425368 A1 1/1996
(Continued)

OTHER PUBLICATIONS

European Search Report dated Jul. 16, 2019 (with English Machine Translation), Application No. 18210759.9-1016—Applicant MULTIVAC Sepp Haggenmueller SE & Co. KG, 18 Pages.

*Primary Examiner* — Gloria R Weeks
(74) *Attorney, Agent, or Firm* — Brooks Kushman P.C.

(57) ABSTRACT

A thermoforming packaging machine that includes a film holder for receiving a lower film supply roll and one behind the other in a sequential arrangement along a production direction a pretreatment station for pretreating the lower film web, a forming station for forming troughs in the lower film web by thermoforming, an insertion line for filling the troughs with products and a sealing station for sealing the troughs with a top film. A transport device is configured to transport the lower film web along the production direction through the pretreatment station, further to the forming station, further to the insertion line and finally to the sealing station. A deflection unit arranged at least partially below the pretreatment station is configured to deflect the lower film web before reaching the pretreatment station. The pretreatment station may include a punching or slitting unit to punch or slit the lower film web.

24 Claims, 3 Drawing Sheets

(51) Int. Cl.

| | |
|---|---|
| ***B65B 65/00*** | (2006.01) |
| ***B65H 23/32*** | (2006.01) |
| ***B65B 41/12*** | (2006.01) |
| ***B65B 25/06*** | (2006.01) |
| ***B65B 31/00*** | (2006.01) |
| ***B65B 47/04*** | (2006.01) |
| ***B65B 51/10*** | (2006.01) |
| ***B65B 61/02*** | (2006.01) |
| ***B65B 9/04*** | (2006.01) |
| *B65B 41/16* | (2006.01) |

(52) U.S. Cl.
CPC ..... *B65B 31/00* (2013.01); *B65B 47/02* (2013.01); *B65B 47/04* (2013.01); *B65B 51/10* (2013.01); *B65B 61/02* (2013.01); *B65B 65/003* (2013.01); *B65H 23/32* (2013.01); *B65H 2301/41704* (2013.01); *B65H 2406/351* (2013.01); *B65H 2701/1752* (2013.01); *B65H 2701/191* (2013.01); *B65H 2701/1944* (2013.01)

(58) Field of Classification Search
CPC ..... B65H 23/32; B65H 2301/41704; B65H 2301/41726
USPC ..... 53/558, 559, 563; 242/615
See application file for complete search history.

(56) References Cited

U.S. PATENT DOCUMENTS 3,911,640 A * 10/1975 Rausing ..... A61L 2/10 53/426
4,304,561 A * 12/1981 Shingo ..... B65H 45/22 493/269
4,420,121 A * 12/1983 Shawcross ..... G03B 1/04 226/189
4,819,406 A * 4/1989 Redmond ..... B65B 57/04 53/51
4,901,993 A * 2/1990 Hansch ..... B42D 1/003 270/21.1
5,667,123 A 9/1997 Fukuda
5,747,781 A * 5/1998 Kim ..... H05B 6/6482 219/685
5,806,285 A * 9/1998 Rizzieri ..... B29C 66/87443 53/122
7,028,940 B2 * 4/2006 McNeil ..... B65H 19/181 242/420.6
7,392,631 B2 * 7/2008 Conti ..... B29C 65/18 226/30
7,487,625 B2 * 2/2009 Natterer ..... B65B 9/04 53/433
7,735,771 B2 * 6/2010 McNeil ..... B65H 23/32 242/615.21
8,876,419 B2 * 11/2014 Sugimura ..... B41J 3/60 400/607
11,059,648 B2 * 7/2021 Orsini ..... B65B 55/20
2004/0055260 A1 * 3/2004 Redmond ..... B65B 61/06 53/561
2004/0248720 A1 * 12/2004 Rosen ..... B31B 70/00 493/356
2005/0056720 A1 3/2005 Natterer
2005/0170940 A1 * 8/2005 Rosen ..... B65D 75/566 493/51
2007/0220833 A1 * 9/2007 Freddi ..... B65B 7/164 53/452
2008/0152772 A1 * 6/2008 Bernig ..... B29C 51/428 426/410
2009/0197750 A1 * 8/2009 Beckmann ..... B29C 66/431 493/11
2009/0272073 A1 * 11/2009 Meyer ..... B65B 47/02 53/141
2010/0095640 A1 * 4/2010 Grimm ..... B65B 47/08 53/453
2010/0115890 A1 * 5/2010 Granili ..... B65B 31/028 53/427
2012/0096814 A1 * 4/2012 Hannen ..... B65B 11/585 53/461
2012/0108409 A1 * 5/2012 Koehn ..... B31B 70/00 493/267
2013/0020370 A1 * 1/2013 Grave ..... B65H 23/32 226/196.1
2014/0150377 A1 * 6/2014 Ehrmann ..... B65B 57/04 53/453
2015/0096263 A1 * 4/2015 Ehrmann ..... B65B 9/04 53/411
2016/0159507 A1 * 6/2016 Izquierdo Ereno ..... B65B 9/045 53/511
2018/0141686 A1 * 5/2018 Christman ..... B65B 59/001
2018/0186484 A1 7/2018 Kikuchi et al.
2020/0047934 A1 * 2/2020 Taguchi ..... G01N 21/359
2020/0207500 A1 * 7/2020 Kalinowski ..... B65B 57/06

FOREIGN PATENT DOCUMENTS

DE 102005048491 A1 4/2007
DE 102006045191 A1 5/2008
DE 102011115881 A1 4/2013
DE 102012018974 A1 3/2014
EP 1 415 915 A1 5/2004
EP 1899251 B1 8/2011
EP 3202671 A2 8/2017
FR 2 887 864 A1 1/2007
WO 2015/136598 A1 9/2015
WO 2017/002915 A1 1/2017

* cited by examiner

THERMOFORMING PACKAGING MACHINE WITH FILM DEFLECTION

CROSS-REFERENCE TO RELATED APPLICATIONS

This Application claims priority to German Patent Application No. 102018204044.3 filed on Mar. 16, 2018 to Elmar Ehrmann, currently pending, the entire disclosure of which is incorporated herein by reference.

FIELD OF THE INVENTION

The present invention relates to the field of thermoforming packaging machines. In particular, the invention concerns a thermoforming packaging machine for packaging food products.

BACKGROUND OF THE INVENTION

From DE 10 2012 018 974 A1, for example, a thermoforming packaging machine is known in which a preheating station, a forming station, an insertion line, a sealing station and a cutting station are arranged one behind the other along a linear production direction. A lower film web is drawn off from a supply roll, which is provided collinearly in front of the preheating station at a film holder with regard to the production direction, and then conveyed along the production direction with a transport device and fed to the individual processing stations. After the lower film web has been preheated at the preheating station to facilitate a thermoforming process, packaging troughs are formed in the lower film web at the forming station using thermoforming. In the insertion line, the packaging troughs are filled with products to be packaged. The filled packaging troughs are then sealed with a top film in the sealing station. At the cutting station, the closed packages are removed from the film composite so that they can then be transported away separately.

A disadvantage of the known thermoforming packaging machine is the high space requirement along the production direction. In order to avoid frequent changes, it would also be advantageous in principle to use lower film supply rolls with a lot of material and a large diameter. However, this further increases the space requirement along the product direction. The space requirement along the production directions is particularly relevant for many applications, as additional devices often need to be arranged in front of the actual thermoforming packaging machine with regard to the production direction. For example, a slicing device for food to be packaged can be arranged in front of the thermoforming packaging machine. The sliced food, for example, slices of sausage or cheese, can then be transported to the feeding line using a feed belt running parallel to the production direction above the forming station, as is known from EP 3 202 671 A2, for example.

SUMMARY OF THE INVENTION

It is an object of the invention to provide a thermoforming packaging machine that can be installed in a space-saving manner.

This problem is solved by a thermoforming packaging machine according to the invention that defines a preferably linear production direction and comprises a film holder for receiving a lower film supply roll, a pre-treatment station, a forming station, an insertion line and a sealing station. The pretreatment station may be configured to pretreat the lower film web. The forming station may be downstream of the pretreatment station with respect to the production direction and comprises a forming tool for forming troughs in the lower film web by thermoforming. In particular, the forming tool can comprise an upper part of the forming tool and a lower part of the forming tool, which may be movable relative to the upper part, between which the lower film web is thermoformed. The insertion line may be downstream of the forming station with respect to the production direction. In the insertion line, the troughs formed in the lower film web are filled with products to be packaged. The sealing station may be downstream of the insertion line with respect to the production direction and comprises a sealing tool for sealing the troughs with a top film. In particular, the sealing tool can comprise a sealing tool upper part and a sealing tool lower part that can be moved relative to it. The top film can, for example, be sealed to the lower film by ultrasonic welding, heat sealing or otherwise. The thermoforming packaging machine also includes a transport device configured to transport the lower film web along the production direction through the pretreatment station, further to the forming station, even further to the insertion line and finally to the sealing station. The transport device may be preferably operated in clocked mode.

The thermoforming packaging machine also comprises a deflection unit which may be configured to deflect the lower film web by an angle with respect to a vertical axis before reaching the pretreatment station. The lower film web may be deflected by the deflection unit after it has left the film holder and before it reaches the pretreatment station. The deflection unit allows the film holder to be positioned more flexibly. In particular, the film holder no longer has to be arranged linearly in front of the individual stations of the thermoforming packaging machine with respect to the production direction. In this way, the overall length of the thermoforming packaging machine can be reduced along the production direction. In addition, the film holder can be positioned in such a way that it may be more easily accessible for changing the lower film supply roll.

The deflection unit may be located at least partially below the pretreatment station. This further reduces the space required along the production direction. The deflection unit uses space under the pretreatment station and thus does not or only to a small extent contribute to the length extension of the thermoforming packaging machine. The deflection unit may be protected and compactly stored under the pretreatment station.

Preferably, the film holder may be provided offset to the production direction. The film holder can be offset either to the left or the right side with respect to the production direction. In addition to the reduced space requirement in the production direction, the accessibility of the thermoforming packaging machine at its front end may be also improved by providing the film holder in an offset position.

The deflection unit can be configured to deflect the lower film web with respect to the vertical axis by an angle between 60° and 120°, an angle between 80° and 100° or an angle of at least substantially 90°. Thus, the film holder can be arranged in such a way that the lower film web may be drawn off from the lower film supply roll essentially along a direction perpendicular to the production direction. It would also be conceivable, however, that further deflection units are provided upstream of the deflection unit provided below the pretreatment station so that the positioning of the film holder can essentially be freely adapted to the respective space requirements.

Preferably, the deflection unit may be configured such that a running direction of the lower film web after deflection through the deflection unit may be parallel or anti-parallel to the production direction at least in projection from above onto the thermoforming packaging machine. Thus, the lower film web can be easily prepared for insertion into the production process of the thermoforming packaging machine.

The thermoforming packaging machine may also include a feeding device suitable for feeding the lower film web into the production sequence of the thermoforming packaging machine and/or into the pretreatment station after being deflected by the deflection unit. The feeding device can transfer the lower film web to the transport device at a suitable height and in a suitable orientation so that it can easily be used a transport device, such as those known in existing thermoforming packaging machines with film holders arranged linearly upstream with respect to the production direction.

Preferably, the feeding device comprises one or more, in particular horizontally aligned, de-flection rolls. After being deflected by the deflection unit, the lower film web can be guided to a suitable height via the deflection rolls in order to be fed to the pretreatment station. Although the deflection unit may be at least partially located below the pretreatment station, the lower film web can be fed to the pretreatment station along the production direction.

The feeding device may be located at least partially below the pretreatment station. Thus, the installation space below the pretreatment station can be exploited even further.

The thermoforming packaging machine preferably comprises a machine frame on which the pretreatment station, the forming station, the insertion line and the sealing station are arranged one behind the other along the production direction. The machine frame may have or define a recess area below the pretreatment station in which the deflection unit may be at least partially arranged. Preferably, the deflection unit may be completely provided in the recess area of the machine frame. It would also be conceivable, however, that the deflection unit projects laterally or to the front beyond the machine frame.

The machine frame may have a cantilever arm projecting in the opposite direction to the production direction on which the pretreatment station may be arranged. The deflection unit may be arranged at least partially below the cantilever arm. The space above the deflection unit can be used for mounting the pretreatment station by providing a cantilever arm of the machine frame.

Preferably, the feeding device may be mounted on the machine frame. This allows the feeding device to be integrated into the thermoforming packaging machine in a simple and space-saving manner.

The pretreatment station may, for example, comprise a preheating station for preheating the lower film web before reaching the forming station. Such a preheating station may be configured relatively flat compared to the forming station or the sealing station so that it may be possible to provide the deflection unit underneath the preheating station without having to lift the machine frame in the region of the preheating station.

Additionally or alternatively, the pretreatment station may comprise a punching or slitting unit configured to punch or slit the lower film web. The punching or slitting unit may be designed to place holes or slits in the lower film web which may later be used in the sealing station to evacuate the packages prior to sealing and/or to introduce a protective gas atmosphere into the packages, for example to increase the shelf life of the products to be packaged.

Preferably, the punching or slitting unit may be integrated and/or mounted on the machine frame. In comparison to the forming station or the sealing station, the punching or slitting unit may be configured to be flat in such a way that the deflection unit may be provided under the punching or slitting unit without raising the overall height of the thermoforming packaging machine in the region of the punching or slitting unit.

Preferably, the punching or slitting unit comprises a waste device configured to collect and/or remove film remains resulting from the punching or slitting of the lower film web. Thus, it may be prevented that film remains in the region of the deflection unit which occur during punching or slitting of the lower film web fall onto the lower film web.

Preferably, the punching or slitting unit comprises a suction device for suctioning off film re-mains resulting from the punching or slitting of the lower film web. Thus, the film remains may be removed automatically and reliably.

Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
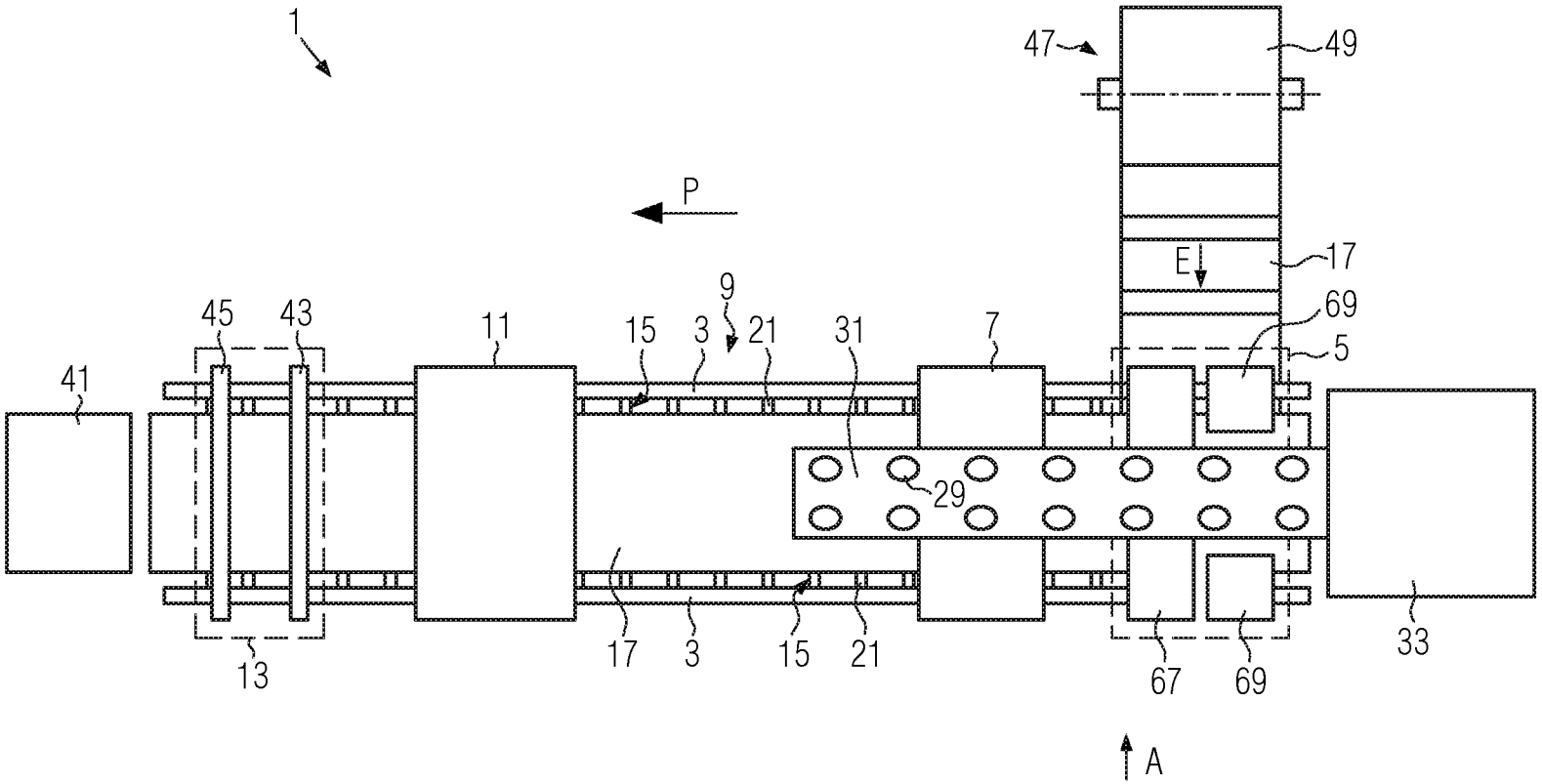
FIG. 1 is a schematic top view of one embodiment of a thermoforming packaging machine in accordance with teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a top view of a thermoforming packaging machine 1 according to an embodiment. The thermoforming packaging machine 1 comprises a machine frame 3, on which a pretreatment station 5, a forming station 7, an insertion line 9, a sealing station 11 and a cut-ting station 13 are arranged linearly one behind the other along a production direction P. In addition, a transport device 15 is provided which is adapted to transport a lower film web 17 along the transport direction P through the pretreatment station 5 further to the forming station 7, even further to the insertion line 9, even further to the sealing station 11 and finally to the cutting station 13.

Figure 2:
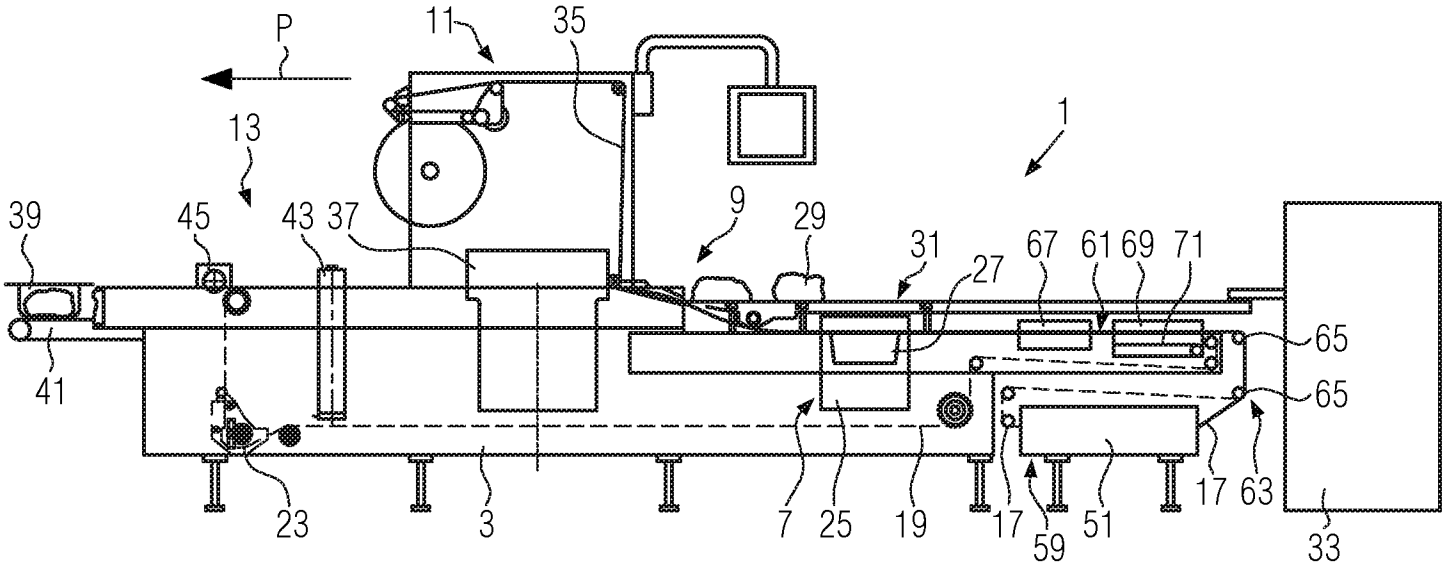
FIG. 2 is a schematic side view of the thermoforming packaging machine of FIG. 1.

FIG. 2 shows a schematic side view of the thermoforming packaging machine 1 in the viewing direction A (see FIG. 1). In the embodiment shown, the transport device 15 comprises clamp chains 19 arranged on both sides of the lower film web 17 which grip the lower film web 17 on both sides using clamp elements 21. The lower film web 17 is conveyed along the production direction P by means of a drive device 23 for the clamp chains 19. The clamp chains 19 are guided on both sides between upper and lower guide rails of the machine frame 3.

The pretreatment station 5 is designed to pretreat the lower film web 17 before reaching the forming station 7. The forming station 7 arranged downstream of the pretreatment station 5 with respect to production direction P comprises a forming tool 25 for forming troughs 27 in the lower film web 17 by thermoforming. In particular, the forming tool 25 may have a forming tool upper part and a forming tool lower part which are movable relative to each other in a vertical direction for thermoforming the troughs 27. In the insertion line 9 arranged downstream of the forming station 7 with respect to the production direction P, the troughs 27 formed in the lower film web 17 are filled with products 29 to be packaged. The troughs 27 may be filled automatically or manually. In the embodiment shown, the products 29 are conveyed from a processing station 33, such as a food cutting device, to the insertion line 9 using a feed belt 31, which runs parallel to the production direction P above the forming station 7. The filled troughs 27 are sealed with a top film 35 in the sealing station 11 arranged downstream of the insertion line 9 with respect to the production direction P. For this, the sealing station 11 comprises a sealing tool 37, which preferably comprises a sealing tool upper part and a sealing tool lower part movable along a vertical direction perpendicular to it. After closing the troughs 27 in the sealing station 11, the packages are separated from the film composite in the cutting station 13 so that the finished and separated packages 39 can then be transported away using a conveying device 41. In the embodiment shown, the cutting station 13 comprises a cross-cutting device 43 and a longitudinal cutting device 45.

As illustrated in FIG. 1, a film holder 47 for receiving a lower film supply roll 49 is arranged laterally offset with respect to the production direction P of the thermoforming packaging ma-chine 1. In the embodiment shown, the film holder 47 is arranged offset by 90° with respect to the production direction P. The removal direction E, along which the lower film web 17 leaves the lower film supply roll 49, is perpendicular to the production direction P. Of course, it would also be conceivable that the film holder 47 would be arranged on the other side of the thermoforming packaging machine 1. The angle between the removal direction E and the production direction P could also deviate from 90°. Due to the laterally offset arrangement of the film holder 47, installation space along the production direction P is saved. In the application example shown, this enables the processing station 33 to be moved closer to the starting point of the thermoforming packaging machine 1. In addition, the film holder 47 can be arranged in such a way that it is particularly easily accessible for changing the lower film supply roll 49.

In order to be able to introduce the lower film web 17 into the production sequence of the thermoforming packaging machine 1 along the production direction P despite the laterally offset film holder 47, a deflection unit 51 is provided. The deflection unit 51 is configured to deflect the lower film web 17 by an angle a with respect to a vertical axis V (and around a vertical axis V') before reaching the pretreatment station 5. In the embodiment shown, the lower film web 17 is deflected by the deflection unit 51 from the removal direction E to an intermediate direction Z, which is antiparallel to the production direction P.

Figure 3:
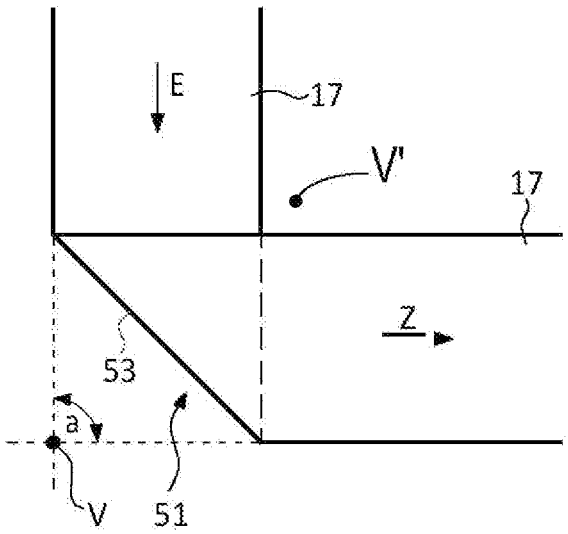
FIG. 3 is a schematic diagram of one embodiment of a mode of operation of a deflection unit of the thermoforming packaging machine of FIG. 1.

Since the deflection unit 51 is at least partially located under the pretreatment station 5 ac-cording to the invention, details of the deflection are not visible in FIG. 1. FIG. 3 therefore schematically shows the deflection of the lower film web 17 through the deflection unit 51 in a top view, whereby adjacent elements of the thermoforming packaging machine 1 are not shown. The lower film web 17 reaches the deflection unit 51 along the removal direction E. At a deflecting edge 53 of the deflection unit 51, the lower film web 17 is then deflected with respect to the vertical axis V (in FIG. 3 perpendicular to the drawing plane) by the angle "a" into the intermediate direction Z, which is antiparallel to the production direction P in the embodiment shown.

In the shown variant, the lower film web 17 is fed to the deflection unit 51 along the removal direction E along which the lower film web 17 leaves the film holder 47. However, this is not absolutely necessary. It would also be conceivable, for example, that further deflection units are provided between the film holder 47 and the deflection unit 51 in order to be able to substantially position the film holder 47 in a completely free manner. Preferably, the lower film web 17 is basically deflected by 90° by the deflection unit 51. Depending on the direction in which the lower film web 17 reaches the deflection unit 51, however, it can also be preferable, if the deflection unit 51 deflects the lower film web 17 by a different angle, for example, by an angle between 60° and 120° or an angle between 80° and 100°.

Figure 4:
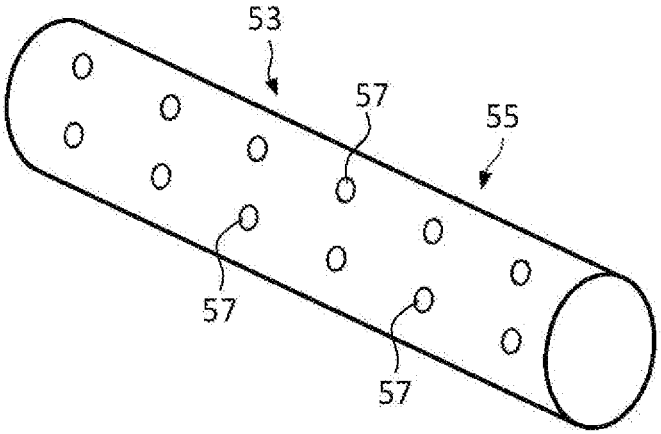
FIG. 4 is a schematic perspective view of one embodiment of a deflection unit included in a thermoforming packaging machine in accordance with the teachings of the present disclosure.

The deflection edge 53 of the deflection unit 51 can, for example, be formed by a cylindrical body 55, as shown in FIG. 4, around which the lower film web 17 is deflected. The cylindrical body 55 preferably comprises compressed air openings 57 through which compressed air escapes during operation so that an air cushion is formed between the cylindrical body 55 and the lower film web 17. This allows the lower film web 17 to be deflected with reduced friction.

As shown in FIG. 2, the machine frame 3 in the shown embodiment comprises a recess area 59 below the pretreatment station 5 in which the deflection unit 51 is arranged. The recess area 59 is formed by the fact that the machine frame 3 has a cantilever arm 61 which projects in the opposite direction to the production direction P and on which the pretreatment station 5 is arranged. The deflection unit 51 is provided in the recess area 59 and is located at least partially below the pretreatment station 5. In this way, the installation space below the pretreatment station 5 is used to realize the deflection of the lower film web 17. The extension length of the thermoforming packaging machine 1 along the production direction P thus can be reduced. In the shown embodiment, the deflection unit 51 is completely provided under the cantilever arm 61 of the machine frame 3 and under the pretreatment station 5. It would also be conceivable, however, that parts of the deflection unit 51 could project laterally or along the production direction P beyond the cantilever arm 61 and/or beyond the pretreatment station 5. Preferably, the deflection unit 51 is at least half, at least 75% or completely under the pretreatment station 5 or the cantilever arm 61.

The thermoforming packaging machine 1 further comprises a feeding device 63 which is con-figured to feed the lower film web 17 into the pretreatment station 5 after it has been deflected by the deflection unit 51. The feeding device 63 does not necessarily have to feed the lower film web 17 into the pretreatment station 5 itself. It is sufficient, if it aligns the lower film web 17 in such a way that it is introduced into the normal production sequence of the thermoforming packaging machine 1, thus, received by the transport device 15 for conveying. In the embodiment shown, the feeding device 63 comprises a plurality of horizontally aligned deflection rolls 65. Preferably, the feeding device 63 is also arranged at least partially under the pretreatment station 5 and/or the cantilever arm 61 in order to save further installation space. The feeding device 63, in particular its deflection rolls 65, can be mounted on the ma-chine frame 3.

In the embodiment in which the lower film web 17 is shown in FIG. 2 as a continuous line, the lower film web 17 leaves the deflection unit 51 along a direction which is anti-parallel to the production direction P, at least in projection from above onto the thermoforming packaging machine 1. It would also be conceivable, however, that the lower film web 17 leaves the de-flection unit 51 along a direction that runs parallel to the production direction P, at least in projection from above onto the thermoforming packaging machine 1. This case is shown in FIG. 2 with dotted lines for the lower film web 17, wherein the corresponding deflection rolls of the feeding device 63 are not shown for the sake of clarity.

In the embodiment shown, the pretreatment station 5 comprises a preheating station 67 for preheating the lower film web 17 before reaching the forming station 7 in order to facilitate thermoforming through the forming station 7. In addition, the pretreatment station 5 in the embodiment shown comprises a punching or slitting unit 69 for punching or slitting the bottom film web 17. Through slits or holes introduced using the punching or slitting unit 69, gas can be suctioned out of the packaging or a protective gas atmosphere can be introduced in the sealing station 11 before the packaging is sealed so that the products can be packaged under vacuum or protective gas atmosphere. The punching or slitting unit 69 shown comprises a suction device 71 for suctioning off film remains arising during or resulting from the punching or slitting of the lower film web 17 so that these cannot fall onto the lower film web 17 in the region of the deflection unit 51. However, suctioning off the film remains is not absolutely necessary and there could also be provided a waste device of another design for the collection and/or removal of film remains resulting from the punching or slitting of the lower film web 17. In the simplest case, a sheet could simply be fitted between the pretreatment station 5 and the deflection unit 51 to collect film remains.

It is also conceivable that the pretreatment station 5 only comprises either a preheating station 67 or a punching or slitting unit 69, but not both. For example, the punching or slitting unit 69 could be integrated into the forming station 7 or could be completely omitted. A punching or slitting unit 69 or a preheating station 67 are particularly well suited for providing the deflection unit 51 underneath, since they have a relatively low overall height compared to, for example, the forming station 7 or the sealing station 11. However, it would also be conceivable that the pretreatment station 5 could alternatively or additionally include another machine unit for pretreating the lower film web 17.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermoforming packaging machine having a production direction, wherein the thermoforming packaging machine comprises:

a film holder for receiving a supply roll of a lower film web;

a pretreatment station for pretreating the lower film web;

a forming station arranged downstream of the pretreatment station with respect to the production direction and having a forming tool for forming one or more troughs in the lower film web by thermoforming;

an insertion line arranged downstream of the forming station with respect to the production direction for filling the one or more troughs with products;

a sealing station arranged downstream of the insertion line with respect to the production direction and having a sealing tool for sealing the one or more troughs with a top film;

a transport device which is configured to transport the lower film web in the production direction sequentially through the pretreatment station, the forming station, the insertion line and the sealing station; and a deflection unit configured to deflect the lower film web by an angle, viewed from above, around a vertical axis before the lower film web reaches the pretreatment station, wherein the angle is transverse to the vertical axis, and wherein the deflection unit is disposed at least partially below the pretreatment station.

2. The thermoforming packaging machine according to claim 1, wherein the film holder is provided offset with respect to the production direction.

3. The thermoforming packaging machine according to claim 1, wherein the deflection unit is configured to deflect the lower film web by an angle between 60° and 120° around the vertical axis.

4. The thermoforming packaging machine according to claim 1, wherein the deflection unit is configured such that a running direction of the lower film web after deflection through the deflection unit is one of parallel to the production direction or anti-parallel to the production direction when viewed from above the thermoforming packaging machine.

5. The thermoforming packaging machine according to claim 1, further comprising a feeding device which is adapted to feed the lower film web into the pretreatment station after being deflected by the deflection unit.

6. The thermoforming packaging machine according to claim 5, further comprising a machine frame upon which the pretreatment station, the forming station, the insertion line and the sealing station are mounted and arranged sequentially one after the other in the production direction, and wherein the feeding device is also mounted on the machine frame.

7. The thermoforming packaging machine according to claim 5, wherein the feeding device comprises at least one horizontally aligned deflection roll.

8. The thermoforming packaging machine according to claim 5, wherein the feeding device is disposed at least partially below the pretreatment station.

9. The thermoforming packaging machine according to claim 1, which comprises a machine frame upon which the pretreatment station, the forming station, the insertion line and the sealing station are arranged sequentially one after the other in the production direction, wherein the machine frame below the pretreatment station has a recess area within which the deflecting unit is at least partially disposed.

10. The thermoforming packaging machine according to claim 9, wherein the machine frame has a cantilever arm that projects in a direction opposite the production direction and wherein the pretreatment station is disposed at least partially on the cantilever arm.

11. The thermoforming packaging machine according to claim 1, wherein the pretreatment station is upstream of the forming station in the production direction and the pretreatment station comprises a preheating station for preheating the lower film web prior to the lower film being transported to the forming station.

12. The thermoforming packaging machine according to claim 1, wherein the pretreatment station comprises a punching or slitting unit configured to punch or slit the lower film web.

13. The thermoforming packaging machine according to claim 12, wherein the punching or slitting unit comprises a waste device configured for collecting and/or removing film remains resulting from the punching or slitting of the lower film web.

14. The thermoforming packaging machine according to claim 12, wherein the punching or slitting unit comprises a suction device for suctioning off film remains resulting from the punching or slitting of the lower film web.

15. The thermoforming packaging machine according to claim 1, wherein the thermoforming packaging machine is configured to feed the lower film web to the transport device so that the lower film web is oriented parallel to the production direction, and so that the lower film web passes through the pretreatment station and the forming station in the production direction.

16. The thermoforming packaging machine according to claim 1, further comprising a feeding device configured to feed the lower film web into the pretreatment station after it has been deflected by the deflection unit so that the lower film web is oriented parallel to the production direction.

17. A thermoforming packaging machine having a production direction, wherein the thermoforming packaging machine comprises:

a film holder for receiving a supply roll of a lower film web;

a pretreatment station for pretreating the lower film web;

a forming station arranged downstream of the pretreatment station with respect to the production direction and having a forming tool for forming one or more troughs in the lower film web by thermoforming;

an insertion line arranged downstream of the forming station with respect to the production direction for filling the one or more troughs with products;

a sealing station arranged downstream of the insertion line with respect to the production direction and having a sealing tool for sealing the one or more troughs with a top film;

a transport device which is configured to transport the lower film web in the production direction sequentially through the pretreatment station, the forming station, the insertion line and the sealing station; and a deflection unit configured to deflect the lower film web by an angle with respect to a vertical axis before the lower film web reaches the pretreatment station, wherein the deflection unit is disposed at least partially below the pretreatment station, and wherein the film holder is arranged laterally offset to a left side or a right side with respect to the production direction.

18. The thermoforming packaging machine according to claim 17, wherein the deflection unit is configured such that a running direction of the lower film web after deflection through the deflection unit is one of parallel to the production direction or anti-parallel to the production direction when viewed from above the thermoforming packaging machine.

19. The thermoforming packaging machine according to claim 17, further comprising a feeding device which is configured to feed the lower film web into the pretreatment station after being deflected by the deflection unit.

20. The thermoforming packaging machine according to claim 17, further comprising a machine frame upon which the pretreatment station, the forming station, the insertion line and the sealing station are arranged sequentially one after the other in the production direction, wherein the machine frame below the pretreatment station has a recess area within which the deflecting unit is at least partially disposed.

21. The thermoforming packaging machine according to claim 20, wherein the machine frame has a cantilever arm that projects in a direction opposite the production direction, and wherein the pretreatment station is disposed at least partially on the cantilever arm.

22. The thermoforming packaging machine according to claim 17, wherein the thermoforming packaging machine is configured to feed the lower film web to the transport device so that the lower film web is oriented parallel to the production direction, and so that the lower film web passes through the pretreatment station and the forming station in the production direction.

23. The thermoforming packaging machine according to claim 17, further comprising a feeding device configured to feed the lower film web into the pretreatment station after it has been deflected by the deflection unit so that the lower film web is oriented parallel to the production direction.

24. A thermoforming packaging machine having a production direction, wherein the thermoforming packaging machine comprises:

a film holder for receiving a supply roll of a lower film web;

a pretreatment station for pretreating the lower film web;

a forming station arranged downstream of the pretreatment station with respect to the production direction and having a forming tool for forming one or more troughs in the lower film web by thermoforming;

an insertion line arranged downstream of the forming station with respect to the production direction for filling the one or more troughs with products;

a sealing station arranged downstream of the insertion line with respect to the production direction and having a sealing tool for sealing the one or more troughs with a top film;

a transport device which is configured to transport the lower film web in the production direction sequentially through the pretreatment station, the forming station, the insertion line and the sealing station; and a deflection unit configured to deflect the lower film web by an angle with respect to a vertical axis before the lower film web reaches the pretreatment station, wherein the deflection unit is disposed at least partially below the pretreatment station, wherein the pretreatment station comprises a punching or slitting unit configured to punch or slit the lower film web, and wherein the punching or slitting unit comprises a waste device configured for collecting and/or removing film remains resulting from the punching or slitting of the lower film web.

* * * * *